US005390790A

United States Patent [19]

Straub et al.

[11] Patent Number: 5,390,790

[45] Date of Patent: Feb. 21, 1995

[54] OCTAGONAL CONTAINER WITH SMOOTH INNER BOTTOM SURFACE

[75] Inventors: Gustave O. Straub, Milwaukee; Ronald G. Lueschen, Winneconne, both of Wis.

[73] Assignee: Jefferson Smurfit Corporation, Clayton, Mo.

[21] Appl. No.: 95,850

[22] Filed: Jul. 23, 1993

[51] Int. Cl.[6] ..... B65D 85/67; B65D 5/00

[52] U.S. Cl. ..... 206/408; 206/395; 229/109

[58] Field of Search ..... 206/408, 395, 389, 303; 229/109, 110

[56] References Cited

U.S. PATENT DOCUMENTS

| | | | |
|---|---|---|---|
| 2,285,174 | 6/1942 | Simons | 229/110 |
| 2,674,400 | 4/1954 | Ross | 206/395 X |
| 2,724,538 | 11/1955 | Schweich | 206/303 X |
| 3,132,791 | 5/1964 | Haysler et al. | 229/109 X |
| 3,246,742 | 4/1966 | Coe | 206/408 X |
| 3,613,973 | 10/1969 | Jaeschke | 206/408 X |
| 3,967,772 | 7/1976 | Baker | 229/110 |
| 4,105,153 | 8/1978 | Locke | 229/109 X |
| 4,119,266 | 10/1978 | Dempster | 229/109 |
| 4,122,949 | 10/1978 | Blatt | 206/303 |
| 4,343,429 | 8/1982 | Cherry | 229/109 |
| 4,614,298 | 9/1986 | Cherry | 229/109 |
| 4,899,927 | 2/1990 | Straub et al. | 229/109 |

*Primary Examiner*—Paul T. Sewell
*Assistant Examiner*—Ted Kavanaugh
*Attorney, Agent, or Firm*—Richard W. Carpenter

[57] ABSTRACT

A one-piece, collapsible, paperboard bulk container for packaging a product such as rubber or plastic hose coiled in bulk. The container has overlapped add interlocked bottom wall inner and outer panels, and the inner panels have opposed edges disposed in abutting relationship to provide a smooth inner bottom surface free from uneven areas that could cause indentation of a packaged product.

7 Claims, 3 Drawing Sheets

FIG. 1
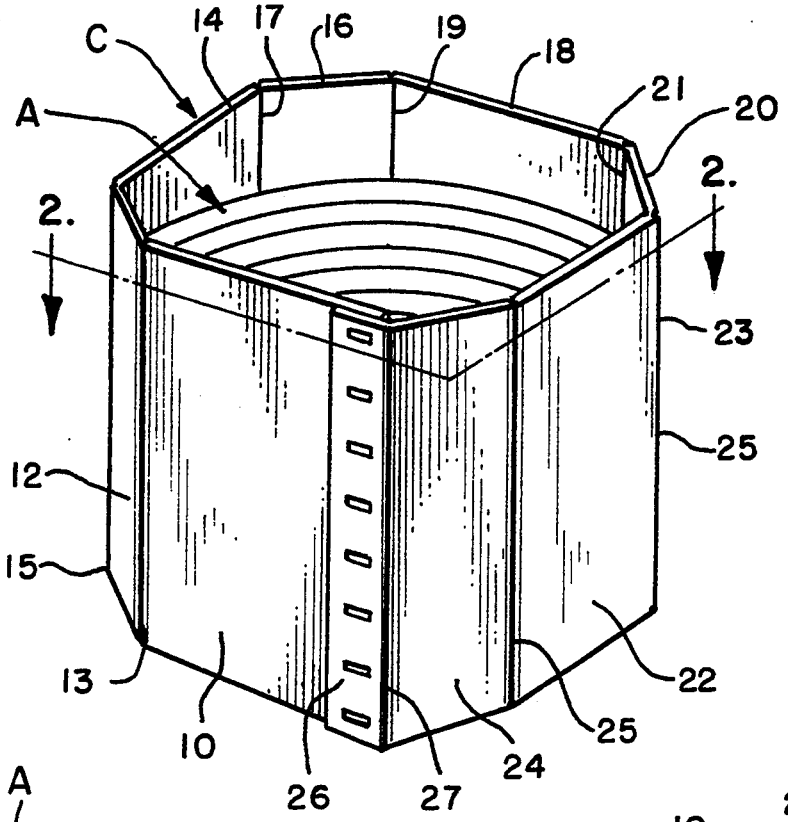
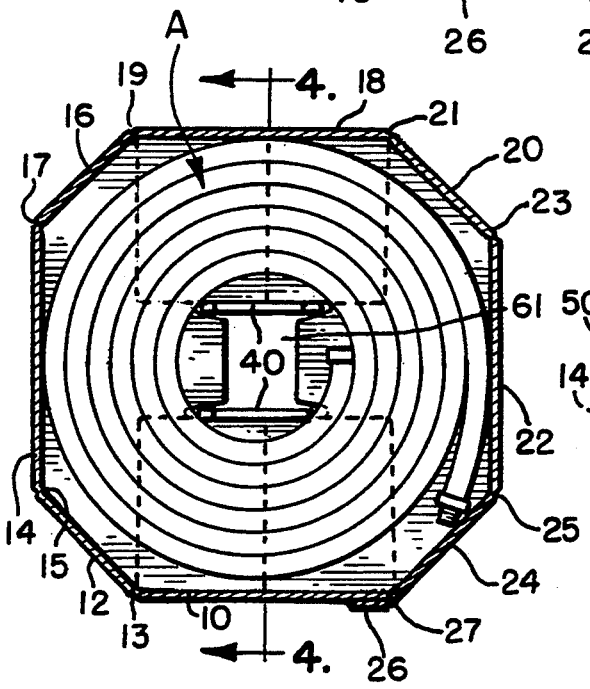
FIG. 2
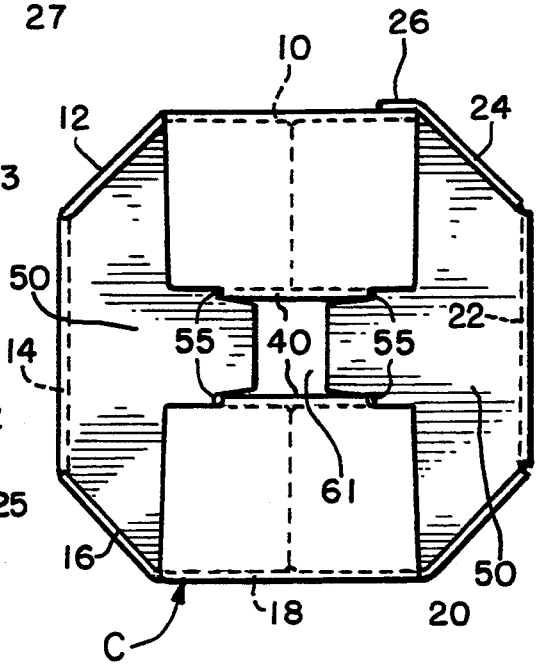
FIG. 3

OCTAGONAL CONTAINER WITH SMOOTH INNER BOTTOM SURFACE

BACKGROUND OF THE INVENTION

1. Field of the Invention

This invention relates to paperboard containers of the type used to package tubular articles, such as rubber or plastic hoses coiled in bulk.

2. Description of the Background Art

A background art search directed to the subject matter of this invention conducted in the United States Patent and Trademark Office disclosed the following U.S. Letters Patent:

3,229,812 4,119,266 4,122,949 4,441,649 4,623,063 4,817,796 4,899,927

None of the patents uncovered in the search discloses a one-piece, collapsible, paperboard bulk container, with overlapped and interlocked bottom wall inner and outer panels, wherein the inner panels have opposed edges disposed in abutting relationship to provide a smooth inner bottom surface free from uneven areas that could cause indentation of a packaged product.

SUMMARY OF THE INVENTION

It is a primary object of the invention to provide an improved paperboard container of the type used to package tubular articles, such as rubber or plastic hose coiled in bulk.

Another object of the invention is the provision of a bulk container of the type described wherein the bottom wall includes an upwardly projecting post for use in positioning a packaged article.

Yet another object of the invention is to provide a container of the type described with a ventilating opening in the bottom.

A more specific object of the invention is the provision of a one-piece, collapsible, paperboard bulk containers with overlapped and interlocked bottom wall inner and outer panels, wherein the inner panels have opposed edges disposed in abutting relationship to provide a smooth inner bottom surface free from uneven areas that could cause indentation of a packaged product.

These and other objects of the invention will be apparent from an examination of the following description and drawings.

BRIEF DESCRIPTION OF THE DRAWINGS

FIG. 1 is a fragmentary perspective view of an erected and filled container embodying features of the present invention;

FIG. 2 is a top plan view of the structure illustrated in FIG. 1;

FIG. 3 is a bottom plan view of the structure illustrated in FIG. 1;

It will be under stood that, for purposes of clarity, certain elements may have been omitted from certain views where they are believed to be illustrated to better advantage in other views.

DESCRIPTION OF THE PREFERRED EMBODIMENT

Figure 6:
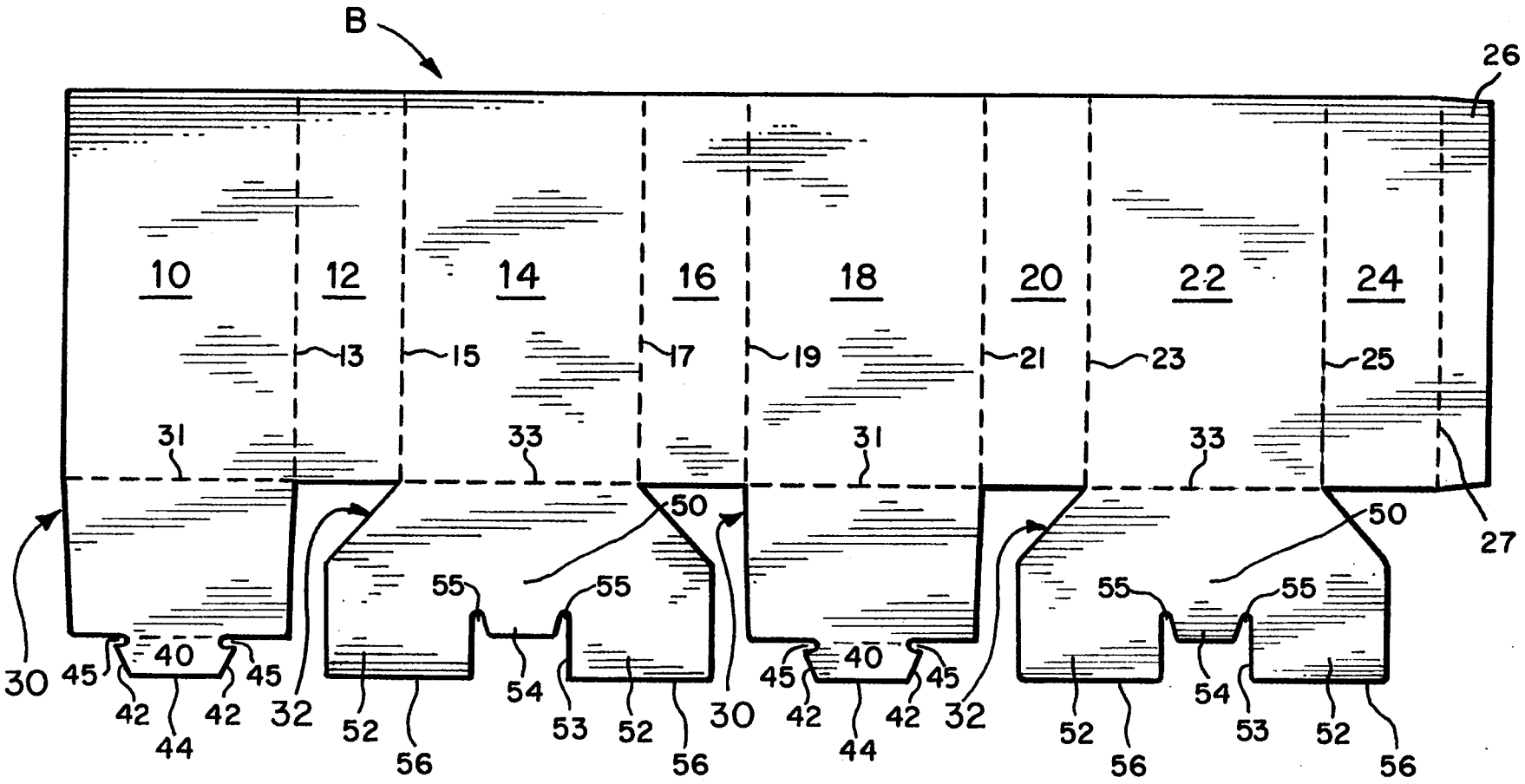
FIG. 6 is a plan view of a blank of paperboard from which the container illustrated in the other views may be formed.

Referring now to the drawings for a better understanding of the invention, it will be seen that the container, indicated generally at C in FIG. 1, can be formed from the unitary blank B of foldable sheet material, such as corrugated paperboard, illustrated in FIG. 6.

Although container C is shown as an octagonal structure, certain principles of the invention could be successfully applied to certain other multi-sided structures.

As best seen in FIG. 2, container C includes a tubular body 6, which is preferably octagonal in cross-section, and an integral, composite, bottom wall 8, having projecting upwardly from the center thereof an integral post 60 adapted to maintain in position a packaged article A, such a plastic or rubber hose coiled in bulk.

Bottom wall 8 may also be provided adjacent, the post, with a ventilating 61 opening extending therethrough.

Figure 4:
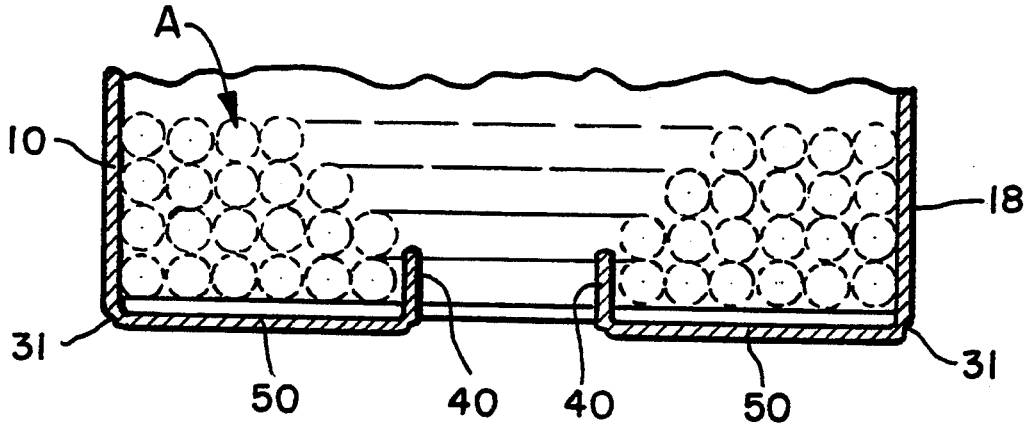
FIG. 4 is a fragmentary, vertical, sectional view taken on line 4—4 of FIG. 2.
Figure 5:
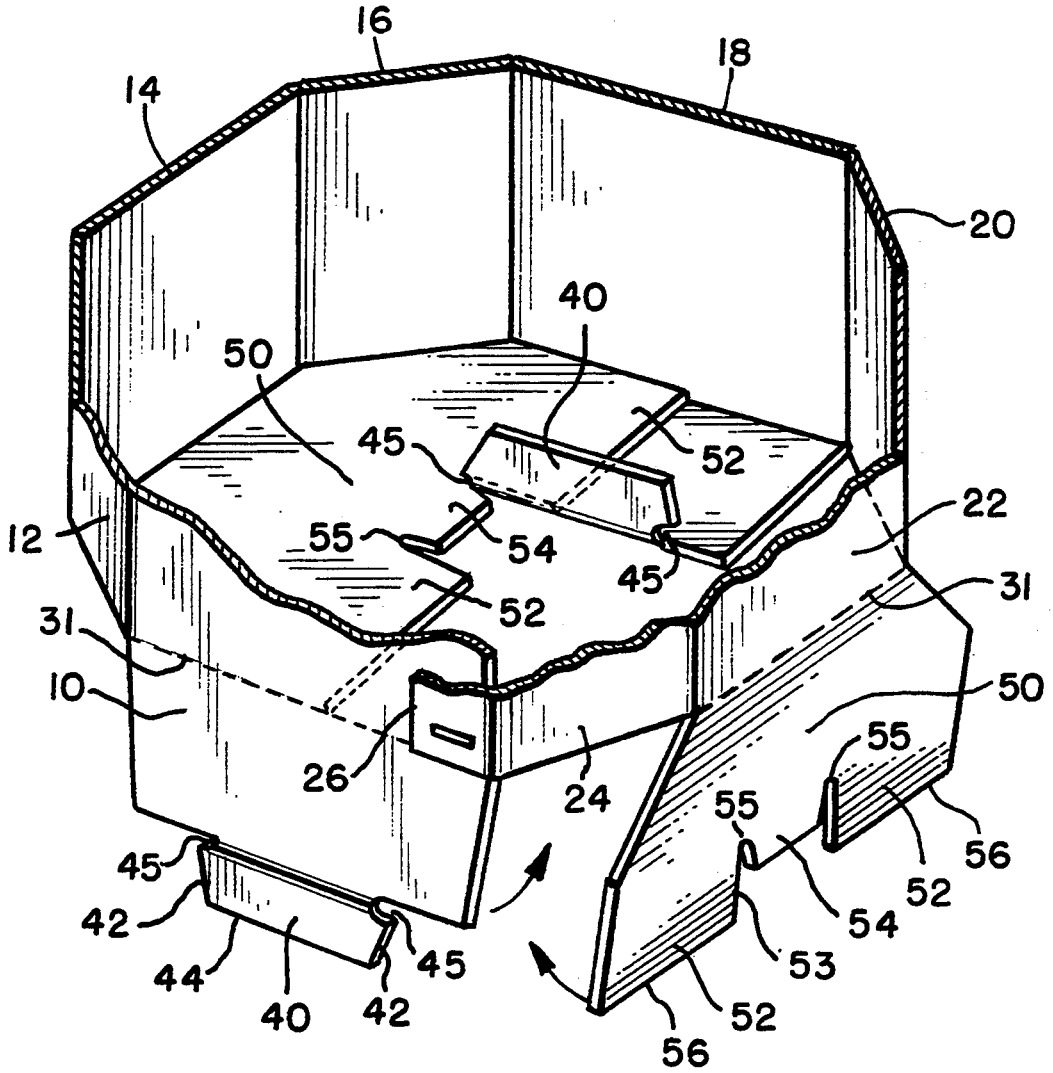
FIG. 5 is a fragmentary perspective view, similar to FIG. 1, but with the container shogun empty and only partly erected.

As best seen in FIGS. 5 and 6, container body 6 includes a plurality of generally rectangular panels which are as follows: a first major side wall panel 10, a first minor side wall panel 12, a second major side wall panel 14, a second minor side wall panel 16, a third major side wall panel 18, a third minor side wall panel 20, a fourth major side wall panel 22, a fourth minor side wall panel 24, and a relatively narrow connecting panel 26, all of which are foldably joined to each other along parallel fold lines 13, 15, 17, 19, 21, 23, 25, and 27, respectively.

When the connecting panel 26 is attached, by an adhesive or staples, to a marginal side portion the first major side wall panel 10, at the opposite end of blank B, the body 6, a collapsible tubular structure, octagonal in cross-section, is formed.

The container bottom wall 8 is a composite structure including a pair of outer panels 30, foldably joined to lower edges of first and third major side wall panels along fold lines 31, and a pair of overlying inner panels 32, foldably joined to lower edges of second and fourth major side wall panels along fold lines 33.

As best seen in FIG. 6, each bottom wall inner panel generally rectangular and has a locking tongue 40 projecting outwardly therefrom.

Each tongue 40 is in the shape of a truncated arrow, with a pair of side edges 42 that diverge rearwardly from the sides of a front edge 44. At the rear of each tongue are a pair of inwardly extending openings 45 that serve to space a rear portion of the tongue from the inner panel itself.

The bottom wall inner panels 32 are somewhat Yoke-shaped and each includes a main portion 50, which is foldably joined to its related major side wall panel on fold line 33, and pair of arms 52 extending outwardly from main portion 50 and spaced laterally from each other to define therebetween a somewhat rectangular recess 53.

Projecting into recess 53 from main portion 50 is an extension or tab 54 which is spaced from arms 52 to define between the tab 54 and the arms 52 a pair of slot-like openings 55, the purpose of which is to receive side portions of the bottom wall outer panel locking tongues 40.

After the connecting panel 26 has been secured to the first major side wall panel 10, as previously described, the container can be shipped to the user in knocked down or flattened condition.

In order to erect the container for use, after the body is opened, the bottom wall can be formed. To form the bottom wall, first the bottom wall inner panels 32 are folded inwardly 90 degrees until they are co-planer, with their respective inner edges 54 disposed in abutting relationship with each other to form a smooth bottom wall inner surface.

Then the bottom wall outer panels 30 are folded inwardly 90 degrees to underlie the inner bottom wall panels. At the same time outer panel locking tongues 40 are then folded upwardly 90 degrees from their respective bottom wall outer panels and inserted through the openings 55 in the bottom wall inner panels to provide an interlocking connection between the inner and outer panels.

As seen in FIG. 2, the lock tabs 40 are spaced laterally a short distance from each other and extend upwardly from the bottom wall inner panels to form a post-like structure that helps maintain a packaged article A, such as a coiled hose, in position.

Also, the recesses 51 in the inner panels form a larger common opening 61 that serves to ventilate the interior of the container.

An extremely essential feature of the invention is that the bottom wall inner panels 32 cooperate to provide a level and smooth bottom wall inner surface with no bumps, ridges, or other uneven areas that could cause indentation of the packaged product, which is the case with respect to other somewhat similar containers that are now available for similar packaging situations.

It should be noted that, although paperboard blank B is illustrated in FIG. 6 of the drawings and described earlier in the specification as a one-piece or unitary blank, if the container to be made requires a blank so large that it can not be formed on available press equipment, the same blank can be formed from two separate sheets of paperboard having adjacent marginal portions secured to each other (not shown) to provide what amounts to acne piece or unitary like blank B of FIG. 6.

What is claimed is:

1. A collapsible one-piece octagonal container having a smooth interior bottom wall surface, said container being formed from a unitary blank of foldable paperboard, and comprising:

(a) first and second pairs of opposed major side wall panels and first and second pairs of opposed minor side wall panels arranged in alternating relationship and foldably joined to each other along vertical edges to form a tubular structure open at its upper and lower ends;

(b) a pair of bottom wall outer panels foldably joined to lower edges of opposed major side wall panels of said first pair and folded inwardly at right angles thereto;

(c) a pair of bottom wall inner panels foldably joined to lower edges of opposed major side wall panels of said second pair and folded inwardly at right angles thereto and overlying said bottom wall outer panels;

(d) said bottom wall outer panels having, projecting from opposed inner edges thereof, locking tongues folded upwardly at right angles from their respective bottom wall outer panels and extending through complementary recesses in said bottom wall inner panels to interlock said inner and outer panels together and thereby form a bottom wall closing said container lower end;

(e) said minor side wall panels having lower end edge free from connection to any other panels, and said bottom wall inner panels having outer edges of the same width as the major side wall panels to which they are foldably joined with diagonal side edges disposed adjacent lower end edges of related minor side wall panels;

(f) said bottom wall inner panels being co-planer and having inner edge surfaces disposed in abutting relationship, whereby said bottom wall has a smooth level surface free from uneven areas, to prevent indentation of a product packaged in said container.

2. A container according to claim 1, wherein said bottom wall has a centrally disposed vent opening extending therethrough.

3. A container according to claim 1, and including a post extending upwardly into the container from said bottom wall and being arranged and disposed centrally of said bottom wall for use in maintaining a packaged article in a predetermined position.

4. A container according to claim 3 wherein said post is formed from free upper end portions of said bottom outer panel locking tongues.

5. A container according to claim 1, wherein each of said bottom wall inner panels is bifurcated and includes a main portion, a pair of legs extending outwardly therefrom and spaced from each other to define an opening therebetween, and a tab projecting from said main portion into said opening to form with said legs slots for receiving portions of said bottom wall outer panel tongues.

6. A blank of foldable paperboard, for use in forming a one-piece collapsible octagonal container which, when erected, has a smooth inner bottom wall surface free from uneven areas that could cause indentation of a packaged product, said blank being cut and scored to provide:

(a) a first major side wall panel, a first minor side wall panel, a second major side wall panel, a second minor side wall panel, a third major side wall panel, a third minor side wall panel, a fourth major side wall panel, and a fourth minor side wall panel serially arranged and foldably joined to each other along adjacent side edges;

(b) a pair of bottom wall outer panels foldably joined to lower edges of said first and third major side wall panels and each having a locking tongue projecting outwardly therefrom;

(c) a pair of bottom wall inner panels foldably joined to lower edges of said second and fourth major side wall panels and each having a pair of openings adapted to receive side portions of both of said bottom wall outer panel locking tongues when said container is in erected condition;

(d) said bottom wall inner panels each having a width equal to one half of the distance between the major side walls to which they are joined, when said container is in erected condition, and having opposed free inboard edges adapted to lie in abutting relationship and thereby present a smooth bottom wall inner surface when said container is in erected condition;

(e) said minor side wall panels having lower end edges free from connection to any other panels, and said bottom wall inner panels having outer edges of the same width as the major side wall panels to which they are foldably joined with diagonal side edges adapted to be disposed adjacent lower end edges of related minor side wall panels when said container is in erected condition.

7. A container blank according to claim 6 wherein each of said bottom wall inner panels is bifurcated and includes a main portion, a pair of legs extending outwardly therefrom and spaced from each other to define an opening therebetween, and a tab projecting from said main portion into said opening to form with said legs slots for receiving portions of said bottom wall outer panel tongues.

* * * * *